US005167734A

United States Patent [19]

Mueller et al.

[11] Patent Number: 5,167,734

[45] Date of Patent: Dec. 1, 1992

[54] PROCESS FOR IDENTIFICATION EVALUATION AND REMOVAL OF MICROSHRINKAGE

[75] Inventors: Peter W. Mueller, Morrow; Thomas F. Berry; Robert E. Allen, both of Cincinnati; Christopher C. Glynn, Hamilton; Larry R. Samons, Mason, all of Ohio

[73] Assignee: General Electric Company, Cincinnati, Ohio

[21] Appl. No.: 804,495

[22] Filed: Dec. 9, 1991

Related U.S. Application Data

[63] Continuation of Ser. No. 501,574, Mar. 30, 1990, abandoned.

[51] Int. Cl.[5] ..... B22D 11/126

[52] U.S. Cl. ..... 148/675; 148/555; 252/79.3

[58] Field of Search ..... 148/2-4, 148/13, 131, 426-429, 555, 556, 675, 676; 29/526.2, 526.3, 527.6; 156/664; 252/79.3

[56] References Cited

U.S. PATENT DOCUMENTS

| | | | |
|---|---|---|---|
| 2,266,430 | 12/1941 | Matthews et al. | 252/79.3 |
| 2,925,497 | 2/1960 | Bessen | 250/53 |
| 2,940,837 | 6/1960 | Acker et al. | 156/664 |
| 3,766,387 | 10/1973 | Heffan et al. | 250/83.3 |
| 4,021,910 | 5/1977 | Freeman et al. | 148/556 |
| 4,032,359 | 6/1977 | Fisher et al. | 252/79.3 |
| 4,171,562 | 10/1979 | Freeman et al. | 29/526.2 |
| 4,353,780 | 10/1982 | Fishter et al. | 252/79.3 |
| 4,358,882 | 11/1982 | Wilkinson | 29/156.8 |
| 4,534,823 | 8/1985 | Fishter et al. | 156/626 |
| 4,582,993 | 4/1986 | Bhattacharya et al. | 250/359.1 |
| 4,819,256 | 4/1989 | Annis et al. | 378/87 |

FOREIGN PATENT DOCUMENTS 1520923 8/1978 United Kingdom .

OTHER PUBLICATIONS

Metals Handbook, 9th Ed, vol. 5; pp. 563-568; 669-675; 1982.

*Primary Examiner*—R. Dean
*Assistant Examiner*—Margery S. Phipps
*Attorney, Agent, or Firm*—Carmen Santa Maria; Jerome C. Squillaro

[57] ABSTRACT

A process for identificaiton, evaluation and removal of microshrinkage of investment cast superalloy parts and parts produced by the process. Parts free of deleterious microshrinkage capable of longer life at existing stress levels or use at higher alternating stresses are produced by first subjecting the parts to hot isostatic pressing to eliminate nonsurface connected subsurface microshrinkage. Next, in order to expose near-surface microshrinkage microscopically connected to the surface, the parts are immersed in an acid solution for a time sufficient to uniformly remove at least about 0.005 inches of the original as cast surface. The exposed microshrinkage is evaluated for acceptability or removal by standard nondestructive techniques, such as liquid penetration evaluation.

9 Claims, 2 Drawing Sheets

PROCESS FOR IDENTIFICATION EVALUATION AND REMOVAL OF MICROSHRINKAGE

This application is a continuation of U.S. patent application Ser. No. 07/501,574, filed Mar. 30, 1990, now abandoned.

TECHNICAL FIELD

This invention relates to a process for identification, evaluation and removal of microshrinkage in investment cast metals, and more particularly, to a process for identification and evaluation of near-surface microshrinkage in investment cast superalloy parts prior to placing the parts in service.

BACKGROUND

The presence of near-surface microshrinkage in investment cast metals is an inherent defect in the investment casting process. Investment cast nickel base superalloys are widely used in modern gas turbine engines, but their use in complex-shaped structural applications has been limited by the presence of such near-surface microshrinkage.

Investment casting involves pouring molten metal into a mold produced by surrounding an expendable pattern with a refractory slurry that sets, after which the pattern is removed, usually through the use of heat. Investment casting permits the making of near net shape parts of very precise dimensions and complex angles and shapes as well as parts having intricate internal structure, such as the internal passages of turbine blades or frame struts, with the need for little or no finishing.

Because investment cast nickel base superalloy parts are used for critical structural applications in modern turbine engines, including such applications as engine mounts, turbine frames, turbine blades, frame struts, combustor casings and pressure vessels, they are subjected to repetitive inspection techniques to identify both surface and subsurface flaws. These inspection techniques include radiographic testing, eddy current testing and penetrant testing and their procedures are well known in industry.

These inspection techniques have been successfully employed to detect most surface and subsurface defects in nickel base superalloy parts used in aircraft engines. In certain instances, these techniques alone have been found to be inadequate to locate certain defects, requiring modifications to standard commonly practiced processes or the addition of operations before these processes can be successfully applied. An example of such a modification is described by Fishter et al. in U.S. Pat. No. 4,534,823, in which the patentees describe a method of detecting minute surface cracks on the metal surface of a machined, wrought IN-100 nickel alloy. This method utilizes standard fluorescent penetrant inspection procedures to detect surface cracks after a very small amount of a smeared machined surface layer, about 0.0001 to about 0.0006 inches, has been removed by chemical milling. This method has been useful for increasing the sensitivity of cracks open to the surface of a worked IN-100 surface using the chemicals and reagents described in the '823 patent, by removal of minute amounts of smeared material.

Such processes and standard inspection methods either alone or in combination have been found to be of no value in detecting defects in investment cast parts referred to as near-surface microshrinkage. Near surface microshrinkage is microscopic voiding of material in investment cast parts located close to, but beneath, the part surface which may be microscopically connected to the part surface. Since the investment casting process randomly produces this difficult-to-detect microshrinkage which can reduce the ability of a part to withstand stress levels encountered in service, it is not uncommon for parts made by the investment casting process to be limited to applications in which the operating stress levels are sufficiently low so as not to adversely affect part performance when such defects are present. As a result, parts made by the investment cast process often are not used in applications in which microshrinkage can reduce the ability of a part to withstand the operating stress levels.

Eddy current inspection is a process which has found to be successful for detecting defects open to the surface of a part. In this method, an electric field is generated within the part, and variations in the electric field indicate the presence of a surface defect. In addition to being limited to the inspection for surface defects, eddy current inspection is also slow and time-consuming, particularly for inspection of complex structural castings.

Dye penetrant inspection is another process which can successfully detect indications open to the surface of a part. Dye penetrant inspection procedures are well known in the industry. In dye penetrant inspection, a low viscosity material is applied to the surface of the part under inspection, and through capillary action, is infiltrated into indications open to the surface, such as cracks or porosity. Excess penetrant is then removed from the surface of the part, and a material capable of drawing the penetrant absorbed into the surface openings is applied to the surface of the part. By capillary action, the penetrant material in the openings is drawn back to the surface, thus revealing the location of indications. When using the visible dye process, the high visibility of the dye contrasted against the background of the part reveals the location of the openings. In the fluorescent penetrant process, illumination of the surface with an ultraviolet light causes fluorescence at locations where the penetrant has been drawn back to the part surface. The limitation of this process is that the indications must have a sufficiently large opening to the part surface in order for the penetrant to be drawn into the indications by capillary action.

While near-surface microshrinkage may be microscopically interconnected to the part surface, the surface connections are so small that capillary action cannot draw the penetrant into the microscopic openings, that is, the openings are beyond the capabilities of this inspection method.

Even when the microscopic openings are large enough to allow the penetrant to enter, the resulting penetrant indication is often indistinguishable from other non-relevant indications attributable to surface roughness of the part, thus resulting in an inspection technique that is not reliable in detecting a defect which may degrade part life when used in critical applications.

Ultrasonic inspection is a process which has been successfully used to detect subsurface indications in materials. Ultrasonic inspection utilizes a high frequency sound beam which is transmitted into the part under inspection. In the commonly used pulse echo method, short bursts of ultrasonic energy are introduced into the test piece at regular intervals of time. If the pulses encounter a reflecting surface, such as a flaw in the part, some or all of the energy is reflected. The proportion of energy that is reflected is highly dependent on the size of the reflecting surface in relation to the size of the incident beam. The direction of the reflected beam (echo) depends on the orientation of the reflecting surface with respect to the incident beam.

Reflected energy is monitored with respect to the amount of initial pulse energy as well as the time delay between the transmission of the initial pulse and receipt of the echo pulse. By using the reflection of the sound energy from the back surface of the part as a reference point, both as a time reference and as an intensity-of-reflected sound reference, flaws can be detected and located at depths within the material.

The limitations of this method include an inability to detect material discontinuities that are present in a shallow layer immediately beneath the surface. This region, commonly referred to as the near field region, is generally the location of microshrinkage. Detection of flaws or indications is further complicated by excessive background "noise" resulting from the reflection of the sound waves from coarse grains usually present in cast parts. This background noise masks reflections from actual indications, thus making ultrasonic methods impractical for inspection of castings.

Radiographic inspection is another method used to detect subsurface discontinuities. In this inspection method, the part is exposed to short wave length electromagnetic radiation. Discontinuities may be either areas where there is a lack of material, and hence a variation in thickness, such as porosity or cracks, or where there is a density difference, such as inclusions. Because of differences in the absorption characteristics of the part at the location where these discontinuities are present, different amounts of radiation pass through the part. These different amounts of radiation, when recorded or observed by detectors, such as radiographic film, reflect the presence of the discontinuity. Among the limitations of radiographic inspection are the inability to detect microporosity, microshrinkage and microfissures unless they are sufficiently segregated to yield a differential density sufficient to represent a detectable gross defect. Also, grain refraction of the beam causes false indications on the X-ray film which tends to mask actual defects. Still another limitation includes difficulties with inspecting parts having complex shapes and varying thicknesses. Finally, this technique is relatively expensive.

Because no reliable nondestructive methods exist to detect the near-surface microshrinkage present in investment cast metal parts, it is currently necessary to rely on destructive techniques to produce parts suitable for use in gas turbine applications. By this technique, representative parts are cross-sectioned after hot isostatic pressing and interrogated for the presence of near-surface microshrinkage. Interrogation involves locating defects, including microshrinkage, and evaluating such defects in accordance with known acceptance standards. The presence of near-surface microshrinkage in excess of predetermined amounts in cross-sectioned parts usually indicates a need to modify the investment casting process for making the parts. But typically, less than about five per cent of the volume of any one casting can be interrogated by this technique.

All of the aforementioned inspection techniques, including sectioning, require an understanding of the art of investment casting in order to tentatively identify and isolate the location of microshrinkage in investment cast parts. These suspect locations are then destructively interrogated, by sectioning, or nondestructively interrogated, for the presence of indications. However, only sectioning has been effective in locating the presence of near-surface microshrinkage. But the information obtained by sectioning is limited to the cross-section which is actually interrogated. The randomness of the casting process also results in an unpredictable variation in the location and severity of the near-surface microshrinkage from one casting to the next.

Because nondestructive testing techniques are unable to find near-surface microshrinkage, and because sectioning is unreliable in ascertaining that subsequently produced castings are free of near-surface microshrinkage, no reliable method currently exists to assure that investment cast parts produced for critical turbine engine applications are free from near-surface microshrinkage.

SUMMARY OF THE INVENTION

An object of the present invention is to provide a reliable method for producing complex investment cast parts which are substantially free from undetected microshrinkage, and suitable for turbine engine structural applications.

Another object of the present invention is to provide a method for uniformly removing a small amount of the exposed cast surface material of an investment cast superalloy part, after hot isostatic pressing, to reveal near-surface microshrinkage not removed by hot isostatic pressing. This microshrinkage may be identified and located for evaluation and disposition by conventional nondestructive test methods such as penetrant testing.

As used herein, subsurface microshrinkage, or subsurface microshrink, refers to voids not connected to the surface of cast parts, formed during the solidification process resulting from the shrinkage of liquid metal. As the liquid metal solidifies, cools and contracts, the voids are formed and entrapped at locations between interlaced dendrites isolated from molten feed metal.

As used herein, near-surface microshrinkage, or near-surface microshrink, refers to voids formed during the solidification process, located close to the surface of cast parts, usually within about 0.02 inches of the surface, and microscopically interconnected to the surface of cast parts, which therefore cannot be removed by a hot isostatic pressing (HIP) process.

As used herein, microshrinkage or microshrink refers to both near-surface microshrinkage and subsurface microshrinkage.

In accordance with the foregoing objects, the invention provides a method for substantially eliminating microshrinkage in an investment casting, comprising the steps of hot isostatic pressing (HIP'ing) the casting to eliminate internal voids, including subsurface microshrinkage, not open to the surface of the casting; cleaning the surface of the HIP'ed casting to remove foreign material from the surface of the casting; then essentially uniformly removing sufficient metal from the surface of the casting thereby exposing latent near-surface microshrinkage. The surface of the casting, prepared in this manner, may then be evaluated for exposed microshrinkage in accordance with known methods using established acceptance criteria.

An important aspect of the present invention is HIP of the investment cast part to produce a casting free of subsurface microshrinkage as the first step of the process to detect and eliminate microshrinkage. The HIP operation consolidates the part, having the effect of removing by consolidation ("healing") gross subsurface defects such as voids (macro)shrinkage, cracks and gas porosity, but leaving surface-connected defects, including near-surface microshrinkage, unaltered. The HIP operation also has the effect of removing any subsurface microshrinkage which is not microscopically interconnected to the surface. The HIP operation has been ineffective in curing near-surface microshrinkage microscopically connected to the part surface. Also the surface openings, being microscopic, are too small for penetrant to enter. This precludes successful detection by typical penetrant techniques. However, the microscopic openings are large enough to allow the high pressure gas used in the HIP,ing operation to enter.

After the HIP operation, the investment cast part is subjected to an operation in which the cast surface of the part is uniformly removed. This removal may be accomplished by any known metal removal technique, such as by grinding or machining. Because the parts may assume complex shapes, grinding and machining often are cost prohibitive or configurationally impossible, and the preferred method of surface material removal is by chemical means, such as by immersion of the part in a suitable reagent which essentially uniformly removes the as-cast surface from the part to a controlled depth. The preferred reagents are aqueous acid solutions which react with the surface of the metallic casting to remove material. This process is referred to as chemical milling, or simply chem milling.

The part may be cleaned using standard foundry techniques before removal of the cast surface to a controlled depth. After chem milling, it is necessary to clean the surface of the part to remove foreign material and/or residual chemicals prior to inspecting the casting for the presence of microshrinkage. The inspection of the casting may be by visual techniques, or visually assisted techniques, such as with magnifying glasses or microscopes. However, the preferred methods are penetrant inspection methods. Although either visible dye penetrant methods or fluorescent penetrant methods may be used, the latter methods are preferred. Of course, this cleaning step optionally may be performed as part of the standard penetrant procedure rather than as an independent step.

Once the microshrinkage has been identified and located, it may be evaluated by comparison with known standards, and if necessary, removed from the affected localized areas by standard removal techniques such as by grinding or machining. Depending upon the depth of removal and part application, it may be necessary to repair the part by welding techniques well-known to those skilled in the art.

DETAILED DESCRIPTION OF THE INVENTION

Pursuant to the present invention, a method is provided for removing microshrinkage in investment cast parts by removing subsurface microshrinkage and subsequently detecting and, when necessary, removing near-surface microshrinkage, and more particularly, for removing microshrinkage in investment cast superalloy parts of the type used in turbine engines, by removing subsurface microshrinkage and subsequently detecting and, when necessary, removing near-surface microshrinkage.

Microshrinkage is an inherent defect in castings. Shrinkage generally occurs during solidification of a casting in regions where there is inadequate feed metal from the gating and risering system to compensate for the natural shrinkage of the metal during solidification and cooling. This shrinkage may result in large voids, or in small microporosity, and it may be located well beneath the surface of the casting or immediately below the cast surface. During solidification, as the metal enters the mold, the metal contacting the surface of the mold freezes, forming a skin. Dendrites advance from the skin, growing into the molten metal as solidification proceeds. As the metal freezes, contraction occurs. When solidification occurs in an area wherein the dendrites are interlaced but leaving liquid metal therebetween, and no path exists to allow liquid metal to flow into these regions as solidification and contraction occurs, voids are created and shrinkage results. This invention is directed to eliminating shrinkage not open to the cast surface, and to detecting shrinkage which is microscopically connected to the surface of the casting and located just below the surface of the casting. Although this invention may be effective in detecting and eliminating microshrinkage in parts cast by most casting processes because the mechanism of microshrinkage formation is common to most casting processes, this invention has been found to be very useful in detecting and eliminating microshrinkage in parts cast by the investment casting process, and in particular, to superalloys cast by this process.

Figure 1:
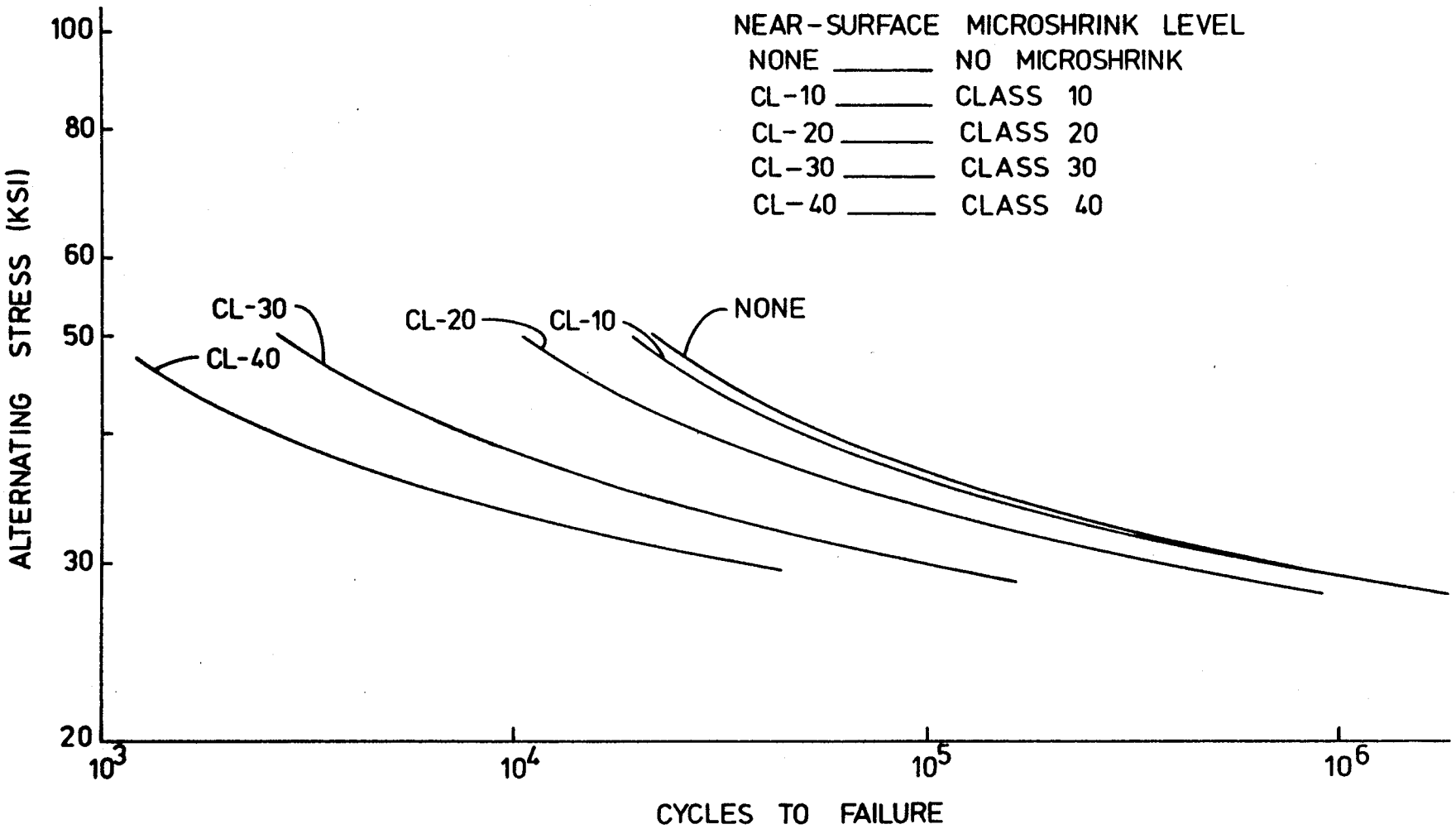
FIG. 1 are low cycle fatigue curves showing the adverse effect of near-surface microshrinkage on the life of investment cast and HIP'ed Inconel 718 (IN-718) parts.

The presence of near-surface microshrinkage may have serious detrimental effects on a cast part, depending on the use of the part. As shown in FIG. 1, the presence of near-surface microshrinkage can seriously decrease the life of a part subject to alternating cyclic stresses. FIG. 1 shows the decrease in the life of a cast and HIP'ed IN-718 part having microshrinkage at various stresses, as well as the design life range for the same part. The severity of the microshrinkage increases from Class 10, the lowest size limit capable of detection by penetrant inspection to Class 40. Elimination of microshrinkage allows designers to utilize a part in applications having higher alternating stresses with no decrease in the number of fatigue cycles which may result in more efficient engines. Alternatively, microshrinkage-free parts experiencing the same alternating stress levels as parts containing microshrinkage can sustain more fatigue cycles before a designer must be concerned with failure. Referring again to FIG. 1, for example, a part having Class 40 microshrinkage and subjected to an alternating stress of about 40 ksi will have a design life of about 2000 fatigue cycles. However, a part free of microshrinkage and subjected to the same alternating stress level will have a design life of about 80,000 fatigue cycles. Such an improvement in the life of parts means less required maintenance and less part replacement, and hence lower operating costs for turbine engine operators.

To date, no reliable nondestructive methods exist to detect near-surface microshrinkage in investment cast nickel base superalloy parts. Near surface microshrinkage is currently detected by cross-sectioning cast parts after HIP'ing and examining the parts for the presence of microshrinkage. As this method is necessarily destructive, it renders the inspected part unusable. Thus, sampling methods must be employed. A further drawback is that inspection by cross-sectioning does not permit interrogation of the entire part, but only those limited surfaces which result from the sectioning process. Thus, while a sectioned surface may not reveal the presence of microshrinkage, an area immediately adjacent may have significant microshrinkage, thus leading to an erroneous conclusion due to the choice of sectioning location. Even though the chosen location is an area known to be susceptible to microshrinkage, there is no assurance that a particular section will have microshrinkage, or, if present, that the microshrinkage will be representative of the microshrinkage produced by the particular casting method.

Current processing of these parts requires HIP,ing of the parts at temperatures as high as about 2125° F. and pressures as high as about 15,000 pounds per square inch. The purpose of the HIP operation is to cure non-surface connected subsurface defects, such as gas porosity, voids and cracks, located in investment cast parts. The HIP operation, however, has no effect on defects open to the casting surface.

This HIP operation has been found to be effective in eliminating microshrinkage, whenever the microshrinkage is located sufficiently below the surface of the casting so that there are no microscopic connections to the surface of the casting. However, the HIP operation has been ineffective in eliminating near-surface microshrinkage located immediately below the surface of the casting which is microscopically connected to the cast surface.

Even though the microscopic connections are so small so as to be impenetrable by a fluid, such as a dye penetrant, as well to be undetectable by visual inspection, the connections are large enough to allow the entry of gas under the high pressures of HIP, thereby rendering the HIP operation ineffectual in healing such microshrinkage. The net result of the HIP operation is to remove only subsurface defects not otherwise connected to the surface, including subsurface microshrinkage, gas porosity and cracks.

Figure 2:
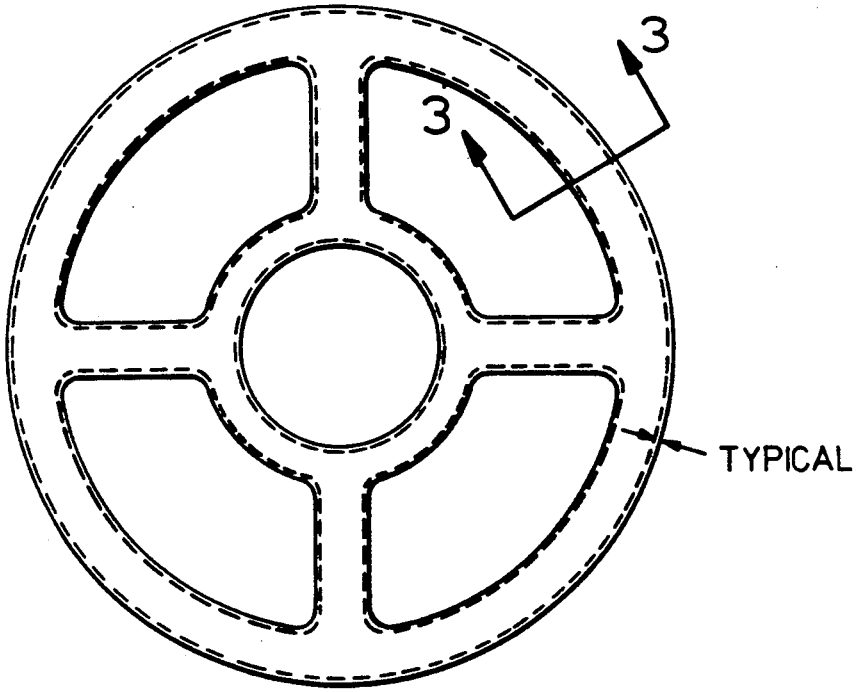
FIG. 2 is a top view of a typical investment cast part showing the original cast surface and the surface after chemical milling to a depth of about 0.02 inches.
Figure 3:
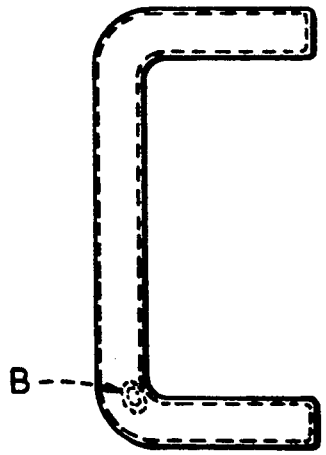
FIG. 3 is a cross-sectional view at position A—A of FIG. 2 showing a typical pocket of near-surface microshrinkage.

The present invention is directed to a method for detecting the remaining near-surface microshrinkage in investment cast nickel base superalloys. A typical investment cast part similar to those used in turbine engines is depicted in FIG. 2 after casting. The part is subjected to the typical HIP operation of the type described above to remove certain internal defects such as subsurface microshrinkage, gas porosity and cracks. However, near-surface microshrinkage, having microscopic interconnections to the surface, as shown in FIG. 3, remains immediately below the cast surface after HIP. The surface of the casting is cleaned in accordance with standard foundry practice. Mechanical cleaning means may be necessary to remove tightly adherent foreign materials.

In order to expose the near-surface microshrinkage, a sufficient amount of the surface layer, i.e. the cast surface, is uniformly removed. The preferred method of accomplishing the uniform removal of the surface layer is by immersion of the entire casting into a suitable reagent which will react to dissolve the metal in a controlled fashion. The preferred reagent is an aqueous acid. The specific aqueous acids will vary depending on the particular alloy from which metal must be removed. In order to achieve uniform metal removal from the surface of the part, particularly for complex parts, it may be necessary to agitate the acid or manipulate the part while immersed in the acid, or both.

In addition to removing metal uniformly from a part, the specific aqueous acid solution chosen for a specific nickel base superalloy must not attack the remaining surface intergranularly. Intergranular attack is defined herein as the preferential attack of the grain boundaries of the surface of the part to a depth of 0.0005 inches or greater. Intergranular attack tends to weaken a part, particularly where it is used in high stress applications. Such a selective attack means that one phase is preferentially attacked with or without pitting and gouging, resulting in a part having an uneven surface.

The amount of metal which must be uniformly removed from the surface of nickel base superalloy castings typically used in turbine applications in order to permit the detection of near-surface microshrinkage is at least 0.005 inches. When an insufficient amount of metal is removed from the surface, the microshrinkage remains undetected. The preferred amount of metal removal is from about 0.008 to about 0.020 inches. Although more metal may be removed, additional removal has been found to be unnecessary to expose near-surface microshrinkage.

When metal is removed from the surface of the casting by use of the preferred chem milling technique of the present invention, the amount of metal removed may be controlled by varying the concentration of the acid bath, by varying the composition of the acid bath, by varying the dwell time of the part within the acid bath, by varying the temperature of the acid or by some combination of these techniques. Although various concentrations and compositions of acids may be used, the most effective control of metal removal from the surface of investment cast IN-718 parts and Rene' 220C parts has been found to occur using solutions of, in volume percent, from about 62% to about 73% ferric chloride having a concentration of 42° Baume', from about 8% to about 12% nitric acid having a concentration of about 42° Baume', from about 10% to about 15% hydrofluoric acid having a concentration of about 42° Baume, and the balance water and incidental impurities, and at temperatures between about 125° F. to about 150° F. for a period of time from about five minutes to about 40 minutes. The amount of metal removed from the surface of the parts under these conditions is within the range of from about 0.005 to about 0.030 inches. Temperatures, concentrations or times different from these may be used, but may result in rates of material removal which are undesirable because they are too rapid or too slow. After the appropriate dwell time in the acid solution, the casting is removed from the acid solution.

After removal of metal from the surface of the casting by chem milling, the casting is rinsed or immersed in clean water to neutralize and remove the acid and any residues. The part is then dryed at a temperature greater than about 250° F., although a preferred temperature range is from about 1600° F. to about 2150° F. Preferably, the drying is performed in a vacuum having a pressure no greater than one Torr, for a period of time from about fifteen minutes to about sixty minutes, to remove any remaining liquid.

Following removal of at least about 0.005 inches of surface material, it is possible to detect the previously undetectable near-surface microshrinkage using standard inspection techniques. Because of the location and size of the microshrinkage, only certain nondestructive methods are currently available. Among the available methods is visual inspection. However, since the microshrinkage is microscopic, any visual inspection techniques must be enhanced by magnification means, such as a magnifying glass or microscope. Thus, the preferred methods for locating subsurface microshrinkage after chemical milling are the penetrant inspection methods. Although either visible dye or fluorescent penetrant methods may be used, the latter is the most preferred method.

The following specific examples describe the materials and processes contemplated by the present invention. They are intended for illustrative purposes only and should not be construed as a limitation.

EXAMPLE 1

An investment cast Inconel 718 (IN-718) part having a nominal composition of, in weight percent, about 19% chromium, about 52.5% nickel, about 3% molybdenum, about 4.9% columbium + tantalum, about 0.9% titanium, about 0.5% aluminum and the balance iron plus incidental impurities, after cleaning using standard foundry techniques, is HIP'ed using standard techniques at a temperature of about 21000F and a pressure of about 15,000 psi to remove subsurface microshrinkage. The part is then completely immersed in an acid bath having the following composition, in volume percent: about 67.5% ferric chloride having a concentration of about 42° Baume', about 10% nitric acid having a concentration of about 42° Baume', about 12.5% hydrofluoric acid having a concentration of about 42° Baume', and the balance water plus incidental impurities maintained at a temperature of about 135° F. Although the temperature may be maintained by any temperature regulating means, the temperature is maintained by electrical resistance heaters located outside the bath, but which conduct and convect heat into the bath. Temperature is monitored using a standard laboratory thermometer. The acid bath is gently agitated by a fan-shaped device made from an acid resisting material driven by an external electric motor. After about ten to about fifteen minutes the part is removed from the acid bath. The amount of metal removal may be increased or decreased by varying the amount of time in the bath, but experience indicates that metal is removed at the rate of from about 0.00075 to about 0.0015 inches per minute. The part is removed and immediately completely immersed completely immersed in water maintained at ambient temperature for about one to about five minutes to neutralize and wash away any residual acid. The water is gently agitated using a fan-shaped device made from an acid resisting material driven by an external electric motor. The part is then vacuum thermal cycled at an atmosphere of about one Torr by placing it in an oven maintained at a temperature of from about 1900° F. to about 1950° F. for about one hour. Next, the part is interrogated for the presence of microshrinkage by standard fluorescent penetrant techniques.

EXAMPLE 2

A Rene' 220C part having a nominal composition of, in weight percent, about 19% chromium, about 3.2% molybdenum, about 5.2% columbium, about 3.2% tantalum, about 0.5% aluminum, about 1.0% titanium, about 12% cobalt and the balance nickel plus incidental impurities, after cleaning using standard foundry techniques, is HIP'ed using standard techniques at a temperature of about and a pressure of about 15,000 psi to remove subsurface microshrinkage. The part is then completely immersed in an acid bath having the following composition, in volume percent: about 67.5% ferric chloride having a concentration of about 42° Baume', about 10% nitric acid having a concentration of about 42° Baume', about 12.5% hydrofluoric acid having a concentration of about 42° Baume', and the balance water plus incidental impurities maintained at a temperature of about 135° F. Although the temperature may be maintained by any temperature regulating means, the temperature is maintained by electrical resistance heaters located outside the bath, but which conduct and convect heat into the bath. Temperature is monitored using a standard laboratory thermometer. The acid bath is gently agitated by a fan-shaped device made from an acid resisting material driven by an external electric motor. After about ten to about fifteen minutes the part is removed from the acid bath. The amount of metal removal may be increased or decreased by varying the amount of time in the bath, but experience indicates that metal is removed at the rate of from about 0.00075 to about 0.0015 inches per minute. The part is removed and immediately completely immersed in water maintained at ambient temperature for about one to about five minutes to neutralize and wash away any residual acid. The water is gently agitated using a fan-shaped device made from an acid resisting material driven by an external electric motor. The part is then vacuum thermal cycled at an atmosphere of about one Torr by placing it in an oven maintained at a temperature of from about 1975° F. to about 2025° F. for about one hour. Next, the part is interrogated for the presence of microshrinkage by standard fluorescent penetrant techniques.

The present invention provides a reliable method for producing complex investment cast parts free of microshrinkage and suitable for turbine engine structural applications. By uniformly removing a small amount of the exposed cast surface material of the part after hot isostatic pressing, microshrinkage not removed by hot isostatic pressing is exposed. This exposed near-surface microshrinkage, previously undetectable except by destructive techniques, may then be located and evaluated for acceptability or removal.

The removal of microshrinkage from investment cast parts allows the designer to utilize these parts in applications having higher stress levels resulting in more efficient engines, or in applications having longer design lives resulting in less maintenance and part replacement. This leads to lower operating costs for turbine engine operators.

The invention in its broader aspects is not limited to the specific embodiments shown and described above. Departures may be made therefrom without departing from the principles of the invention and without sacrificing its chief advantages.

The invention having thus been described, what is claimed as new and desired to be secured by Letters Patent is:

1. A method for detecting and substantially eliminating microshrinkage in a casting, comprising the steps of:
hot isostatically pressing the casting to eliminate internal voids and subsurface microshrinkage not open to the surface of the casting;
cleaning the surface of the casting to remove foreign material; and
then, essentially uniformly chemically removing at least 0.005 inches of metal from the surface of the casting to expose near-surface microshrinkage, wherein said step of essentially uniformly chemically removing metal from the surface of the casting includes the operations of:
immersing the casting in an aqueous acid solution for about five to forty minutes;
rinsing the casting in clean water; and
drying the casting in a vacuum environment maintained at a pressure of no greater than about one Torr at a temperature of about 1600° F. to about 2150° F. for about fifteen minutes to about sixty minutes.

2. The method of claim 1 wherein said aqueous acid solution comprises, in volume percent, from about 62% to about 73% ferric chloride having a concentration of 42° Baume', from about 8% to about 12% nitric acid having a concentration of about 42° Baume', from about 10% to about 15% hydrofluoric acid having a concentration of about 42° Baume' and the balance water and incidental impurities.

3. The method of claim 2 wherein said aqueous acid solution comprises, in volume percent, about 67.5% ferric chloride having a concentration of about 42° Baume', about 10% nitric acid having a concentration of about 42° Baume', about 12.5° hydrofluoric acid having a concentration of about 42° Baume', and the balance water plus incidental impurities.

4. The method of claim 1 wherein said aqueous acid solution is maintained at a temperature of from about 125° F. to about 150° F.

5. The method of claim 4 wherein said acid solution is maintained at a temperature of about 135° C.

6. The method of claim 1 wherein the casting is an investment cast superalloy.

7. The method of claim 6 wherein the investment cast superalloy casting has a nominal composition of, in weight percent, about 19% chromium, about 52.5% nickel, about 3% molybdenum, about 4.9% columbium + tantalum, about 0.9% titanium, about 0.5% aluminum and the balance iron plus incidental impurities.

8. The method of claim 6 wherein the investment cast superalloy casting has a nominal composition of, in weight percent, about 19% chromium, about 3.2% molybdenum, about 5.2% columbium, about 3.2% tantalum, about 0.5% aluminum, about 1.0% titanium, about 12% cobalt and the balance nickel plus incidental impurities, comprising the steps of:
hot isostatically pressing the casting to eliminate internal voids and subsurface microshrinkage not open to the surface of the casting;
cleaning the surface of the casting to remove foreign material;
then, essentially uniformly chemically removing sufficient metal form the surface of the casting to expose near-surface microshrinkage; and
then, inspecting the surface of the casting for microshrinkage.

9. The method of claim 1 wherein said step of essentially uniformly chemically removing metal form the surface of the casting includes removing from about 0.008 to about 0.020 inches of metal.

* * * * *